United States Patent [19]

Impastato

[11] 4,112,594

[45] Sep. 12, 1978

[54] COLOR COORDINATING IMPLEMENT

[76] Inventor: Leona R. Impastato, 27 Gray Rock La., Chappaqua, N.Y. 10514

[21] Appl. No.: 792,018

[22] Filed: Apr. 28, 1977

[51] Int. Cl.[2] ..... B44D 2/00

[52] U.S. Cl. ..... 35/28.3; 356/192

[58] Field of Search ..... 35/28.3, 28.5; 356/191, 356/192

[56] References Cited

U.S. PATENT DOCUMENTS

| | | | |
|---|---|---|---|
| 1,125,078 | 1/1915 | Dunn | 35/28.3 X |
| 1,764,083 | 6/1930 | Miskella | 35/28.3 X |
| 2,240,053 | 4/1941 | Richardson | 35/28.3 X |

*Primary Examiner*—Harland S. Skogouist

*Attorney, Agent, or Firm*—Robert E. Burns; Emmanuel J. Lobato; Bruce L. Adams

[57] ABSTRACT

An implement for coordinating the colors of fabric and the like comprises a circular base portion of cardboard or other stable sheet material having therein a series of circular openings which are arranged in a circle concentric with the base member. Each of the openings is surrounded by an annular band of color, the colors of the band being selected in such manner that colors which blend are disposed adjacent one another while contrasting colors are located at the opposite side of the base member. Each of the annular color bands is divided into a plurality of sectors which are shades of the respective color. A central indicator member is rotatably mounted on the base concentric therewith and is of smaller diameter than the base member so as to be located inside the circle of openings and their respective color bands. The indicator member bears indices indicating the key color, adjacent blending colors and opposite contrasting colors. A rotatable opaque disc underlies the base member and has a single opening which by rotation of the disc can be brought into registration with one or another of the openings in the base member. In use the implement is placed on a colored article and positioned so that the article shows through the opening in the base member which is surrounded by a band matching the color of the article. The indicator member is then turned so that the index representing the key color is adjacent the band of the color of the article whereupon other indices of the indicating member indicate blending colors and contrasting colors.

5 Claims, 2 Drawing Figures

COLOR COORDINATING IMPLEMENT

FIELD OF INVENTION

The present invention relates to a color coordinating implement for use in selecting colors of colored material which blend with or contrast a selected color.

BACKGROUND OF THE INVENTION

The selection of suitable colors is highly important in many fields of activity. For example in garment construction it is desirable to select colors which blend with one another or which are contrasting. The selection of colors is also important in choosing shoes, gloves, handbags or other accessories for use with dresses, coats, suits or other clothing. The selection of color is also important in the field of interior decorating, for example in selecting wallpaper, paints, carpets, drapes, etc.

While skilled professionals in these fields have an eye for color, persons who are less experienced, for example the home dressmaker or householder who undertakes his own home decorating frequently make poor choices in color selection so that unattractive color combinations result. By reason of the cost of materials and the labor involved such mistakes can be expensive.

SUMMARY OF THE INVENTION

It is an object of the present invention to provide a color coordinating implement which greatly simplifies the problem of selecting blending or contrasting colors so as to achieve pleasing color combinations. In accordance with the invention a circular base member of cardboard or other stable sheet material is provided with a series of openings arranged in a circle. Each of the openings is surrounded by an annular band of color, the colors being so arranged that blending colors are disposed adjacent one another and contrasting colors are disposed at opposite sides of the base member. An indicator member which is rotatably mounted on the base member concentrically with the circular series of openings is provided with indices designating the key color, blending colors and contrasting color. In use the implement is placed on a colored article and positioned so that the article is seen through the opening which is surrounded by a color band matching the color of the article. The indicator member is then turned so that the index representing the key color is adjacent the selected opening and associated color band. Other indices on the indicator member thereupon indicate blending colors and contrasting color. Preferably each of the color bands is divided into a plurality of sectors each of which is a selected shade of the respective color. Moreover, a concentric rotatable disc is preferably provided below the base member and has a single opening which can, by rotation of the disc member, be brought into registration with any one of the openings of the base member so that the article being viewed is seen through a single opening.

BRIEF DESCRIPTION OF DRAWINGS

The nature, object and advantages of the invention will be more fully understood from the following description of a preferred embodiment shown by way of example in the accompanying drawings in which.

DESCRIPTION OF PREFERRED EMBODIMENT

Figure 2:
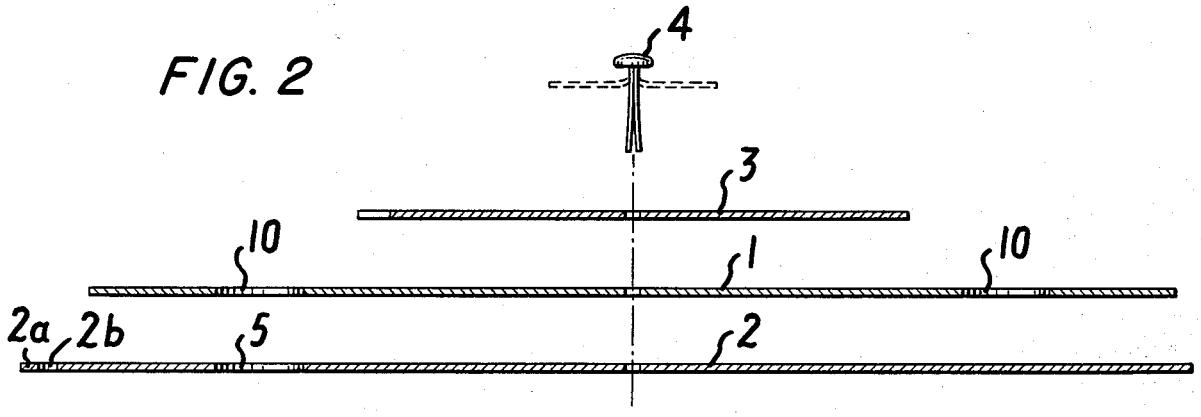
FIG. 2 is a schematic exploded cross sectional view.

The color coordinating implement shown by way of example in the drawings comprises a circular base member 1, and underlying disc member 2 and an overlying generally circular indicating member 3. As seen in the drawings the underlying disc 2 is somewhat larger than the circular base member 1 while the indicator member 3 is smaller. The three members 1, 2 and 3 are formed of cardboard, plastic or other lightweight sheet material having sufficient stability and strength. Moreover, the indicator member 3 and particularly the base member 1 need to have upper surfaces which are satisfactorially receptive to printing with colored ink. The three members 1, 2 and 3 are concentrically superposed on one another and are rotatably connected by a pivot pin 4, for example a hollow rivet or a paper fastener, as illustrated in FIG. 2. Although the members 1, 2 and 3 are shown separated in FIG. 2 for the sake of clarity it will be understood that they are in fact superposed on one another.

Figure 1:
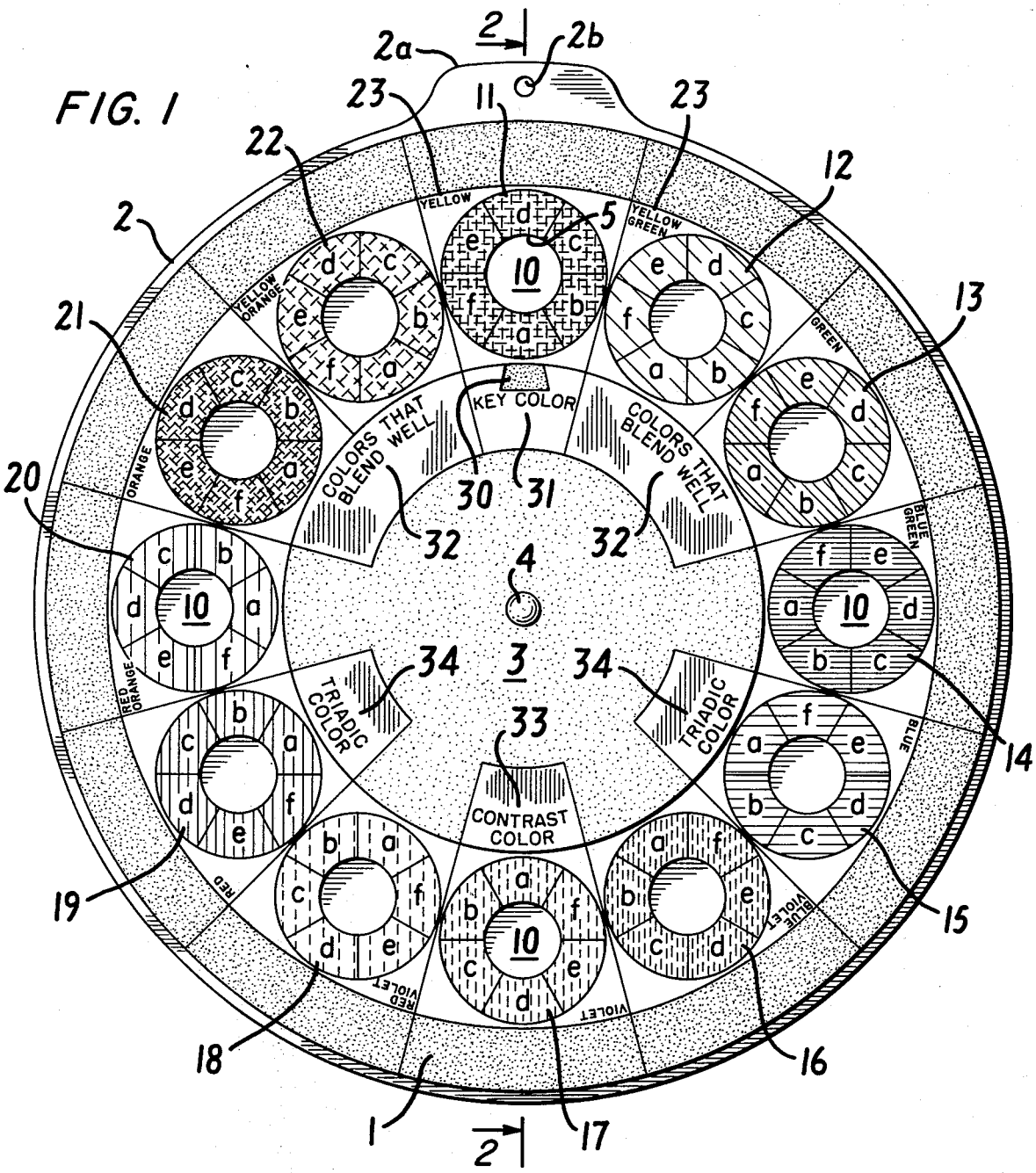
FIG. 1 is a plan view of a color coordinating implement in accordance with the invention.

The base member 1 is provided with a series of openings 10 which are arranged in a circle concentric with the pivot 4. By way of example twelve such openings are shown in FIG. 1. Each of the openings is surrounded by an annular band of color. The color bands are designated 11, 12, 13, 14, 15, 16, 17, 18, 19, 20, 21 and 22 respectively. The colors of the color bands 11–22 are selected so that colors which blend well are disposed adjacent one another. Thus for example the color band 11 is yellow while the adjacent color bands 12 and 22 are yellow green and yellow orange respectively. Contrasting colors are disposed at diametrically opposite sides of the base member. For example the color band 13 is green while the opposite color band 19 is red.

Moreover, each of the color bands 11–22 is divided into a plurality of sectors. By way of example each of the color bands is shown divided into six equal sectors designated *a, b, c, d, e,* and *f* respectively. The sector *a* of each color band gives the basic color of the band while the sectors *b, c, d, e,* and *f* are progressively different shades or tints of the basic color. By way of example the color and shade or tint of each of the sectors of each of the color bands 11–22 is set out in the following chart in which the colors are identified by standard Pantone numbers.

| Circle Number | Color | a Sector | b Sector | c Sector | d Sector | e Sector | f Sector |
|---|---|---|---|---|---|---|---|
| 11 | Yellow | Yellow | 102 | 459 | 458 | 104 | 105 |
| 12 | Yellow Green | 382 | 381 | 585 | 584 | 384 | 385 |
| 13 | Green | 368 | 367 | 578 | 577 | 370 | 371 |
| 14 | Blue Green | 340 | 339 | 564 | 563 | 342 | 343 |
| 15 | Blue | 300 | 299 | 543 | 542 | 302 | 303 |
| 16 | Blue Violet | 273 | 272 | 536 | 535 | 275 | 276 |
| 17 | Violet | 266 | 265 | 529 | 528 | 268 | 269 |
| 18 | Red Violet | 259 | 258 | 515 | 514 | 261 | 262 |
| 19 | Red | 185 | 184 | 487 | 486 | 187 | 188 |
| 20 | Red Orange | 172 | 171 | 473 | 472 | 174 | 175 |
| 21 | Orange | 151 | 150 | 466 | 465 | 153 | 154 |
| 22 | Yellow Orange | 123 | 122 | 452 | 451 | 125 | 126 |

While the base member 1 has been shown as being provided with twelve openings 10 each surrounded by a color band it will be understood that a different number of openings can be used. For example the base member 1 may be provided with six openings in which case the color bands would be the six primary and secondary colors, namely yellow, green, blue, violet, red and orange. Moreover, each of the color bands may be divided into a larger or a smaller number of sectors. However, in order to provide a wide range of colors and shades it is preferred to have twelve color bands each divided into six sectors, as illustrated in the drawing.

The shades of color in the respective bands are so selected that the shade of each sector will go with the shade of the corresponding sector of any of the other color bands. Thus for example the shade of sector *c* of the color band 11 will go with the shade of the corresponding sector *c* of any of the other color bands.

The openings 10 in the base member 1 make it possible to see the color being considered, for example the color of fabric, paper or of a paint sample through the opening and hence in immediate juxtaposition to all of the sectors of the respective color band. So as to use only one opening at a time and thereby permit concentration and avoid confusion the rotatable disc member 2 is provided with only one opening 5 which by rotation of the disc 2 relative to the base member 1 can be brought into registration with a selected one of the openings 10 in the base member. As the disc 2 is of somewhat larger diameter than the base member 1 it can easily be rotated relative to the base member and will be retained by friction in the position to which it is rotated. Moreover, rotation of the disc 2 is facilitated by a tab **2*a* which projects from one side of the disc member. A hole 2*b*** in the tab provides convenient means by which the color coordinating implement can be hung up.

The indicator disc member 3 is of smaller diameter than the base member 1 so as to fit inside of the circle of color bands as seen in FIG. 1. At one point in its circumference the indicator member 3 is provided with a notch 30 adjacent to which there is provided an index reading KEY COLOR. The notch 30 provides a convenient means for rotating the indicator member 3 relative to the base member 1. Moreover, the underlying portion of the base member 1 is preferably of a different shade from the portion indicator member 3 adjacent the notch 30 so that the contrast makes the notch 30 clearly visible. On opposite sides of the index KEY COLOR there are provided indicia 32 reading COLORS THAT BLEND WELL. The circumferential extent of each of the indices 32 corresponds to two of the color bands on the base member 1 as seen in FIG. 1. Diametrically opposite the index KEY COLOR there is provided an index 33 reading CONTRAST COLOR. The circumferential extent of the index 33 corresponds to one of the color bands on the base member 1. At 120° from the index KEY COLOR there are provided indices 34 reading TRIADIC COLOR. The annular color bands on the base member 1 are preferably separated by radial lines which define sectors of a circle. Likewise, the indicia 31, 32, 33 and 34 on the indicator member 3 are preferably bounded by radial lines which by relative rotation of the base member and indicator member can be brought into alignment with the radial lines of the base member. To facilitate identification of the colors of the color bands 11–22 a legend 23 is provided adjacent each color band. These legends correspond to the colors given in the above color chart.

The color coordinating implement of the present invention is used by placing it on the fabric or other material the color of which is to be considered. The lower disc member 2 is rotated relative to the base member 1 so as to bring the opening 5 into registration with the opening 5 of the base member 1 inside the color band which corresponds to the color of the material being observed. The material as seen through the opening 10 is thus in immediate juxtaposition to all of the sectors of the respective color band. The indicator member 3 is then rotated relative to the base member 1 to bring the notch 30 and the index KEY COLOR into alignment with the selected color band. Thus for example in the drawing the index KEY COLOR is shown adjacent the color band 11. The indices COLORS THAT BLEND WELL thereupon indicate colors that blend with the color of the material being observed. Thus for example if the KEY COLOR is yellow the blending colors include yellow orange, orange, yellow green and green. The index CONTRAST COLOR indicates a color that contrasts with the key color. As illustrated by way of example in the drawings the CONTRAST COLOR is violet. The indices 34 indicate TRIADIC COLORS in the present case every fourth color of the series. The TRIADIC COLORS provide dramatic color combinations. As illustrated by way of example in FIG. 1 the TRIADIC COLORS are yellow, blue, and red.

Moreover when the color of the material being considered is observed through the opening 10 it will be noted which sector of the surrounding color band corresponds to the observed color. The corresponding sectors in the other color bands provide shades of color which go well with the shade of the color under consideration. For example if the color being observed matches the shade of sector *c* in color band 11 then sector *c* in each of color bands 12, 13, 21 and 22 is of a shade of color that blends well with the color under consideration and sector *c* of color band 17 is an appropriate shade of contrast color. Likewise, for the triadic colors of color bands 15 and 19 the shade of sector *c* is appropriate.

It will thus be seen that the color coordinating implement of the present invention provides a useful and convenient means not only for selecting colors that blend well, contrast color and triadic colors but also for selecting appropriate shades of the respective colors.

Although a preferred embodiment of the invention has been illustrated in the drawings and is herein particularly described it will be understood that many modifications and variations may be made and hence that the invention is in no way limited to the illustrated embodiment.

What is claimed is:

1. A color coordinating implement comprising a generally circular base member of stable sheet material having therein a series of openings arranged in a circular concentric with said base member, an annular band of color surrounding each of said openings, the colors of said color bands being selected in the manner that colors which blend well are disposed adjacent one another while contrasting colors are disposed at opposite sides of said base member, and an indicator member rotatably mounted on said base member concentric therewith, said indicator member being radially inside said circular series of openings and surrounding color bands, said indicator member having thereon indices to indicate key color, colors blending with said key color and contrasting color, whereby in use said implement is placed over a colored article and positioned so that said article shows through a selected one of said openings which is surrounded by a band having a color matching the color of said article and said indicator member is turned so that the key color index thereof is positioned adjacent said selected opening and associated color band whereupon said blending color indices indicate blending colors and said contrasting color index indicates contrasting color each of said annular color bands being divided into sectors each of a shade of the respective color of said band.

2. A color coordinating implement according to claim 1, further comprising indicia on said indicator member positioned to indicated triadic colors when said key color index is positioned adjacent said selected opening.

3. A color coordinating implement according to claim 1, further comprising an opaque disc member which underlies said base member and is rotatable coaxially relative to said base member, said disc member having a window which by rotation of said member relative to said base member can be brought into registration with any one of said openings, whereby when said implement is placed over a colored article said article will be seen only through that opening of the base member with which said window of the disc member is in registration.

4. A color coordinating implement according to claim 3, in which said disc member is of larger diameter than said base member.

5. A color coordinating implement according to claim 1, comprising indicia associated with and identifying each of said sectors of said annual color bands.

* * * * *